United States Patent [19]

MacCracken

[11] Patent Number: 4,761,970

[45] Date of Patent: Aug. 9, 1988

[54] IMMISCIBLE PROPELLANT AND REFRIGERANT PAIRS FOR EJECTOR-TYPE REFRIGERATION SYSTEMS

[75] Inventor: Calvin D. MacCracken, Englewood, N.J.

[73] Assignee: Calmac Manufacturing Corporation, Englewood, N.J.

[21] Appl. No.: 60,650

[22] Filed: Jun. 11, 1987

[51] Int. Cl.[4] ..... F25B 1/06

[52] U.S. Cl. ..... 62/500; 417/151

[58] Field of Search ..... 62/500, 116; 417/151

[56] References Cited

U.S. PATENT DOCUMENTS

| | | | |
|---|---|---|---|
| 3,276,216 | 10/1966 | Papapanu | 62/500 |
| 3,701,264 | 10/1972 | Newton | 62/500 |
| 4,416,856 | 11/1983 | Durand et al. | 417/151 |
| 4,438,633 | 3/1984 | Hiser | 62/500 |

*Primary Examiner*—Ronald C. Capossela

*Attorney, Agent, or Firm*—Charles J. Brown

[57] ABSTRACT

An ejector-type vapor compression refrigeration system wherein the coefficient of performance is maximized by the selection of the propellant and refrigerant fluids, the propellant being a perfluorocarbon immiscible with the refrigerant and having a relatively low heat of vaporization and high molecular weight and the refrigerant having a relatively high heat of vaporization and low molecular weight.

6 Claims, 1 Drawing Sheet

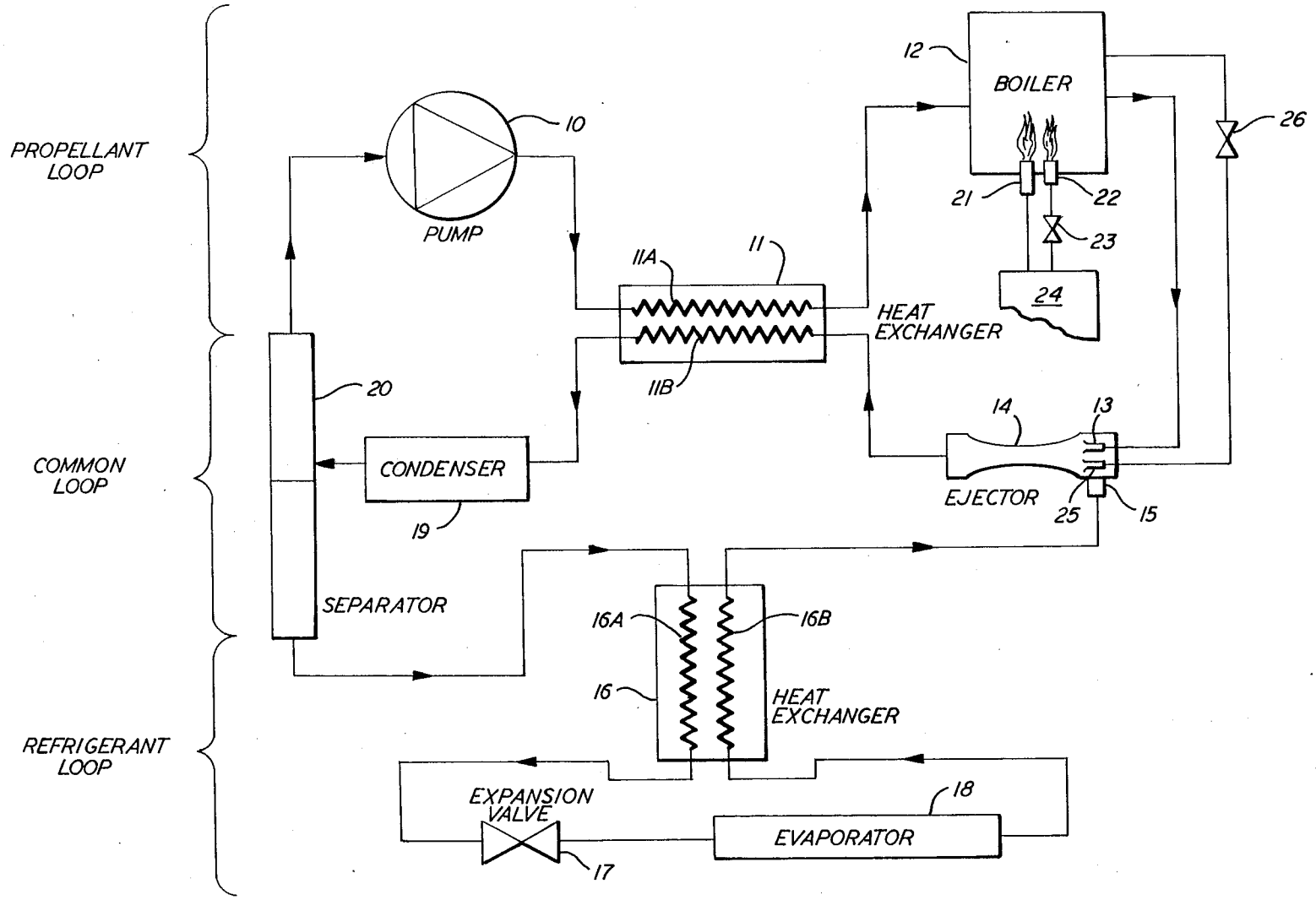
26
BOILER
22
23
24
21
12
HEAT EXCHANGER
13
15
25
14
EJECTOR
11
11A
11B
10
PUMP
CONDENSER
19
20
SEPARATOR
16B
HEAT EXCHANGER
16A
16
18
EVAPORATOR
EXPANSION VALVE
17
PROPELLANT LOOP
COMMON LOOP
REFRIGERANT LOOP

IMMISCIBLE PROPELLANT AND REFRIGERANT PAIRS FOR EJECTOR-TYPE REFRIGERATION SYSTEMS

BACKGROUND OF THE INVENTION

Ejector-type refrigeration systems have long been known employing a single fluid as both a high-velocity propellant or motive gas stream and as a slower moving secondary refrigerant gas stream entrained in and accelerated by the propellant. (The term "refrigeration systems" as used herein shall mean systems functioning in a cooling or refrigeration mode and also in a heating mode as a heat pump). The resulting kinetic energy of the mixture is subsequently used for self-compression to a higher pressure, thus fulfilling the function of a compressor. A full description of such a single-fluid system is set forth in a paper entitled "Investigation Of An Ejector Heat Pump By Analytical Methods" by C. T. Hsu published July 1984 by the Oak Ridge National Laboratory for the United States Department of Energy.

An early article cited therein namely "Performance Of Ejectors As A Function Of The Molecular Weights Of Vapors" by Work and Haedrich, Industrial And Engineering Chemistry, April 1939, pages 464 to 477, suggests employing two separate fluids as the propellant and refrigerant and mentions the problem of separating of the propellant from the refrigerant for recycling back through their respective loops. While it states that separation might be accomplished by gravity separation with immiscible fluids (page 476), it does not disclose any particular immiscible fluids which would be operable for the purpose.

It is the principal purpose of this invention to maximize the coefficient of performance (COP) of an ejector-type refrigeration system by selection of particular immiscible propellant and refrigerant fluids. The invention in particular is directed to pairs of immiscible fluids which not only have a large difference in heat of vaporization but which are also chosen to avoid most of the negative effect of adding of vapor pressures in the condenser. In the condenser the vapor pressures of two immiscible fluids add together making it inefficient for condensation to take place at typically high pressures.

STATEMENT OF THE INVENTION

The improvement of the invention is in an ejector-type vapor compression refrigeration system wherein a propellant fluid is directed in its own loop from a pump to a boiler and a refrigerant fluid is directed in its own loop from an expansion device to an evaporator and the two fluids are then joined in a common loop at an ejector followed by a condenser and then a separator from which they are redirected to their own loops. The improvement comprises a propellant fluid which is immiscible with the refrigerant fluid and which is a perfluorocarbon containing at least five carbon atoms and at least ten fluorine atoms and which has a pour point below about 50 degrees F. This is to be paired with a refrigerant fluid having a molecular weight less than about 80, and a heat of vaporization greater than about 150 Btu's per pound, and preferably having an atmospheric boiling point between about 20 and about 200 degrees F. lower than that of the propellant fluid. The refrigerant is preferably at least one fluid selected from a group consisting of water, an organic compound containing carbon, hydrogen and oxygen, an organic compound containing carbon, hydrogen and nitrogen and an organic compound containing carbon, hydrogen and sulfur.

A preferred selection of the perfluorocarbon propellant fluid is from a group consisting of perfluoralkanes, perfluorotertiary amines and perfluoroethers. That propellant is to be paired with a refrigerant fluid preferably selected from the group consisting of methanol, ethanol, methyl formate acetalydehyde, n-propanol, iso propanol, acetone and water.

The improvement of the invention is applicable to ejector-type systems whether employed in a cooling mode or as a heat pump. In either case coefficients of performance (COPS) are surprisingly higher than any previously obtained with absorption, desiccant or other heat-actuated cycles. The systems of the invention are simple and reliable with no moving parts except one pump.

BRIEF DESCRIPTION OF DRAWING

The single FIGURE is a flow diagram of an ejector refrigeration system in the cooling mode for use with the immiscible propellant and refrigerant fluids of the invention.

DESCRIPTION OF PREFERRED EMBODIMENT

Referring to the FIGURE the propellant fluid is directed in its loop as a liquid from a pump 10 to a warming side 11A of a heat exchanger 11 where it is pre-heated by rejected heat from a source described below. The propellent liquid then enters and is vaporized in a boiler 12 fired by gas or other fuel or industrial or engine waste heat. The propellant gas exiting from the boiler 12 is at a temperature much higher than that of the propellant liquid exiting from the pump 10 but with no substantial change in pressure.

From the boiler 12 the propellant gas passes through a nozzle 13 of an ejector 14 at very high velocity creating a substantial vacuum which entrains a refrigerant gas entering from a suction port 15.

The refrigerant fluid begins in its own loop as a liquid chilled in a cooling side 16A of a heat-exchanger 16. The refrigerant liquid then enters an expansion device 17 and then an evaporator 18 from which it emerges as a very low-pressure gas at a low refrigerant temperature. The chilled refrigerant gas is then warmed in a warming side 16B of the heat exchanger 16 and directed to the suction port 15 of the ejector 14.

The propellant gas with the refrigerant gas entrained therein exits from the ejector 14 at a much higher temperature and somewhat higher pressure than the entry temperature and pressure of the refrigerant at the suction port 15, and at a somewhat lower temperature and much lower pressure than the entry temperature and pressure of the propellant gas at the nozzle 13. The propellant and entrained refrigerant then are directed to a cooling side 11B of the heat exchanger 11 where it is cooled at constant pressure. Together the propellant and refrigerant gases enter a condenser 19 where they are chilled slightly at constant pressure to liquefy. They are then directed to a gravity-type separator 20. Since the fluids are immiscible the lighter refrigerant liquid separates to the top and the heavier propellant liquid separates to the bottom. The liquid refrigerant is recycled to the heat exchanger 16 and the liquid propellant is recycled to the pump 10.

The propellant fluid should have a low heat of vaporization as compared to the refrigerant fluid and to achieve that the propellant fluid should have a high molecular weight. The vapor pressures of the immiscible propellant and refrigerant fluids add at the condenser which means that if the two immiscible fluids have the same or similar atmospheric boiling points, the pressure needed for condensing at a given temperature will be doubled. For miscible fluids this does not occur. However, if the atmospheric boiling point of the refrigerant fluid is less than about 20 degrees F. lower than that of the propellant fluid, the vapor pressure of the propellant fluid at the condensing temperature will be much less and have little effect on the necessary condensing pressure. If the atmospheric boiling point of the refrigerant fluid is more than about 200 degrees F. lower than that of the propellant fluid the difference in pressure between the boiler pressure of the propellant fluid and the condensing and evaporating pressure of the refrigerant fluid is too small to achieve sufficient jet velocity in the ejector.

The refrigerant fluid should have a heat of vaporization greater than about 150 Btu's per pound and a molecular weight less than about 80, the two being generally inversely related according to Trouton's constant. The propellant fluid should have a pour point, which is similar to a freezing point, of below about 50 degrees F.

To meet these various criteria the invention provides that the propellant fluid be a perfluorocarbon containing at least five carbon atoms and at least ten fluorine atoms. Those which are perfluoralkanes are:

| Formula | Name | Mol. Wt. | Boiling Point F. | Atmos. Pour Point F. |
|---|---|---|---|---|
| $C_5F_{12}$ | Perfluoropentane | 288 | 86 | −175 |
| $C_6F_{14}$ | Perfluorohexane | 338 | 133 | −101 |
| $C_8F_{18}$ | Perfluorooctane | 438 | 216 | −44 |
| $C_9F_{20}$ | Perfluorononane | 488 | 253 | −3 |

The presence of oxygen or nitrogen is not unacceptable and therefore they may be in the form of a perflourotertiary-amine in which the carbon-fluorine group is tripled and a nitrogen added such as $(C_4F_9)_3N$, or in the form of a perfluoroether in which oxygen is added such as $C_8F_{16}O$. Oxygen or nitrogen do not measurably change the heat of vaporization when there are so many of the strong overpowering fluorine atoms.

In accordance with the foregoing criteria the invention provides that the refrigerant fluid be either water or an organic compound containing carbon, hydrogen and oxygen, or carbon, hydrogen and nitrogen or carbon, hydrogen and sulfur. The following are at least possible:

| refrigerant | formula | mol. wt. | b. pt. | ht. of vap'n. |
|---|---|---|---|---|
| methanol | $CH_4O$ | 32 | 149 | 527 |
| ethanol | $C_2H_6O$ | 46 | 173 | 379 |
| methylformate | $C_2H_4O_2$ | 60 | 90 | 202 |
| acetalydehyde | $C_2H_4O$ | 44 | 70 | 297 |
| furan | $C_4H_4O$ | 68 | 89 | 172 |
| ethylformate | $C_3H_6O_2$ | 74 | 130 | 183 |
| ethylmethylether | $C_3H_8O$ | 60 | 51.4 | 192 |
| n-propanol | $C_3H_8O$ | 60 | 207 | 339/312 |
| iso propanol | $C_3H_8O$ | 60 | 180 | 320 |
| acetone | $C_3H_6O$ | 58 | 134 | 237 |
| diethylether | $C_4H_{10}O$ | 74 | 94 | 169 |
| dimethylamine | $C_2H_7N$ | 45 | 46 | 266 |
| diethylamine | $C_4H_{11}N$ | 73 | 133 | 180 |

-continued

| refrigerant | formula | mol. wt. | b. pt. | ht. of vap'n. |
|---|---|---|---|---|
| methylamine | $CH_5N$ | 31 | 20 | 359 |
| ethylamine | $C_2H_7N$ | 45 | 62 | 259 |
| propylamine | $C_3H_9N$ | 59 | 118 | 226 |
| trimethylamine | $C_3H_9N$ | 59 | 97 | 194 |
| pyridine | $C_5H_5N$ | 79 | 93 | 219 |
| methanethiol | $CH_4S$ | 48 | 43 | 237 |
| ethanethiol | $C_2H_6S$ | 62 | 95 | 196 |
| water | $H_2O$ | 18 | 212 | 1071 |

Methanol and water are preferred. Ethanol, methyl formate, acetaldelyde, n-propanol, iso-propanol and acetone are the next order of preference. The remaining refrigerants are somewhat less preferred. All of the propellant and refrigerant fluids provided by the invention are stable and relatively non-toxic, non-corrosive and inexpensive. Most importantly they are mutually immiscible with the perfluorocarbons described.

In one example of the invention the propellant fluid is $(C_8F_{16}O)$ or perfluorcyclic ether the atmospheric boiling point of which is 216 degrees F. and the refrigerant fluid is methanol $CH_4O$ the atmospheric boiling point of which is 149 degrees F. In the propellant loop from the pump 10 through the heat exchanger 11 and boiler 12 to the ejector nozzle 13 the pressure of the propellant remains substantially constant at about 220 psia. Its temperature increases, however, from 100 degrees F. out of the pump 10 to about 290 degrees F. out of the heat exchanger 11 to 430 degrees F. out of the boiler 12. In the refrigerant loop from the separator 20 to the expansion valve 17 the refrigerant holds at a constant pressure of 5.9 psia but its temperature drops from 100 degrees F. to 45 degrees F. From the expansion valve 17 through the evaporator 18 the refrigerant temperature drops to 40 degrees F. and its pressure drops to 0.74 psia. Through the heat exchanger 16 to the suction port 15 of the ejector 14 the temperature of the refrigerant increases to 90 degrees F. while its pressure holds at 0.74 psia. In the common loop the mixed gases emerge from the diffuser of the ejector 14 at a pressure of about 5.9 psia and about 330 degrees F. and then are cooled at nearly constant pressure to about 160 degrees F. in the heat exchanger 11B before entering the condenser 19 where they are cooled further to 100 degrees F. Since the vapor pressure of the methanol refrigerant is 4.6 psia but the vapor pressure of the perfluorocarbon propellant is only about 1.3 psia, the pressure increase for condensation is only about twenty-eight percent, or a total pressure of 5.9 psia.

One negative aspect of the ejectory-type vapor compression system as utilized in the invention is that its performance efficienty and capacity is sensitive to condenser temperature, which is to say to ambient weather conditions. On a hot day approximately 35% capacity and efficiency may be lost when an air-cooled condenser is used, whereas electric compressors would lose only 17%. This disadvantage is offset by a gain in efficiency at a steep rate in milder weather so that the efficienty on a yearly basis is quite good. A solution to this problem is to provide the gas boiler 12 with a variable gas flame, or perhaps a second additional flame, and an extra nozzle in the ejector 14 codirected with the nozzle 13 to provide extra nozzle flow during peak periods. In the drawing a primary gas flame 21 in the boiler 12 is shown in conjunction with such a second gas flame 22 controlled by a valve 23, both operating from a gas source 24, and the nozzle 13 in the ejector 14 is shown in conjunction with an extra nozzle 25 controlled by a valve 26. The use of the additional gas flame in the boiler and the extra nozzle could reduce the overall coefficients of performance (COPS) due to overloading of the boiler and ejector beyond their maximum efficiency points, but it would only be for a relatively brief period measured in hours during an entire year. As a result on a hot day the decrease in capacity and efficiency would only be a fraction of what it might otherwise be.

It is to be understood in the following claims that the compression system of the invention may be used either as a refrigeration system or a heat pump. It is well known to cause a system to be used as one or the other simply by the use of reversing valve means. Here two reversing valves would be used. One would direct the flow from the ejector 14 to the condenser 19 in the cooling mode of the figure or alternately from the ejector 14 to the unit 18 (now a condenser rather than an evaporator) in the heat pump mode. The second reversing valve would direct the flow from the condenser 19 to the separator 20 in the cooling mode of the figure or alternately from the unit 18 (now a condenser rather than an evaporator) and thence to the separator 20 in the heat pump mdoe. It is to be further understood that the term ejector as used herein includes an injector, and that the ejector may include eliptical, swirl, annular or other configurations in addition to the traditional concentric type.

I claim:

1. In an ejector-type vapor compression refrigeration system wherein a propellant fluid is directed in its own loop from a pump to a boiler and a refrigerant fluid is directed in its own loop from an expansion device to an evaporator and the two fluids are then joined in a common loop at an ejector followed by a condenser and then a separator from which they are redirected to their own loops, the improvement which comprises (a) the propellant fluid being immiscible with the refrigerant fluid and consisting of at least one perfluorocarbon containing at least five carbon atoms and at least ten fluorine atoms and having a pour point below about 50 degrees F.;

(b) the refrigerant fluid having a molecular weight less than about 80 and a heat of vaporization greater than about 150 Btu's per pound.

2. A vapor-compression system according to claim 1 wherein the refrigerant fluid has an atmospheric boiling point between about 20 and about 200 degrees F. lower than that of the propellant fluid.

3. A vapor-compression system according to claim 1 wherein the refrigerant fluid is at least one fluid selected from a group consisting of water, an organic compound containing carbon, hydrogen and oxygen, an organic compound containing carbon, hydrogen and nitrogen and an organic compound containing carbon, hydrogen and sulfur.

4. A vapor-compression system according to claim 1 wherein the perfluorocarbon is selected from a group consisting of perfluoroalkanes, perfluorotertiary amines and perfluoroethers.

5. A vapor-compression system according to claim 1 wherein the refrigerant fluid is selected from the group consisting of water, methanol, ethanol, methyl formate, acetalydehyde, n-propanol, iso-propanol and acetone.

6. A vapor-compression system according to claim 1 wherein the boiler is fired by gas flame means including means for selectively increasing the heating affect of the gas flame, and the ejector includes nozzle means for the propellant fluid including means for selectively increasing the nozzle flow capacity, whereby the heating affect of the boiler and propellant flow through the ejector can be selectively increased to offset a decrease in capacity and efficiency caused by said condenser during periods of high ambient temperature.

* * * * *